US006875098B2

(12) United States Patent
Takahashi et al.

(10) Patent No.: US 6,875,098 B2
(45) Date of Patent: Apr. 5, 2005

(54) ELECTROPLATED GRINDING WHEEL AND ITS PRODUCTION EQUIPMENT AND METHOD

(75) Inventors: Tsutomu Takahashi, Iwaki (JP); Naoki Shimomae, Iwaki (JP); Hanako Hata, Iwaki (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/754,322

(22) Filed: Jan. 5, 2001

(65) Prior Publication Data

US 2001/0014578 A1 Aug. 16, 2001

(30) Foreign Application Priority Data

Jan. 19, 2000 (JP) ..... 2000-010844

(51) Int. Cl.[7] ..... B24D 3/00

(52) U.S. Cl. ..... 451/548; 451/359; 451/549; 51/307; 51/293

(58) Field of Search ..... 451/343, 546, 451/548, 541, 359, 549; 51/307, 293, 295, 309; 428/143, 161, 168

(56) References Cited

U.S. PATENT DOCUMENTS

| | | | | | |
|---|---|---|---|---|---|
| 1,336,751 | A | * | 4/1920 | Linbarger | 451/546 |
| 3,802,130 | A | * | 4/1974 | Lindenbeck | 451/544 |
| 3,918,217 | A | | 11/1975 | Oliver | |
| 4,047,902 | A | * | 9/1977 | Wiand | 451/548 |
| 4,411,107 | A | * | 10/1983 | Sekiya et al. | 451/450 |
| 5,468,178 | A | * | 11/1995 | Kitko et al. | 451/28 |
| 5,496,209 | A | * | 3/1996 | Gaebe | 451/548 |
| 5,853,319 | A | * | 12/1998 | Meyer | 451/548 |
| 5,951,381 | A | * | 9/1999 | Videcoq et al. | 451/255 |
| 6,123,612 | A | * | 9/2000 | Goers | 451/540 |
| 6,200,360 | B1 | * | 3/2001 | Imai et al. | 428/143 |

FOREIGN PATENT DOCUMENTS

| | | | | |
|---|---|---|---|---|
| EP | 0 393 540 | | 10/1990 | |
| EP | 0 950 470 | | 10/1999 | |
| GB | 778 811 | | 7/1957 | |
| GB | 0282440 | A2 * | 9/1988 | 451/546 |
| JP | 5-162080 | | 6/1993 | |
| JP | 5-285846 | | 11/1993 | |
| JP | 6-114743 | | 4/1994 | |
| JP | 9-019868 | | 1/1997 | |
| JP | 9-117865 | | 5/1997 | |
| JP | 9-225827 | | 9/1997 | |
| JP | 10-058306 | | 3/1998 | |
| JP | 10-193269 | | 7/1998 | |
| JP | 10-277919 | | 10/1998 | |

* cited by examiner

*Primary Examiner*—Lee D. Wilson
*Assistant Examiner*—Anthony Ojini
(74) *Attorney, Agent, or Firm*—Oblon, Spivak, McClelland, Maier & Neustadt, P.C.

(57) ABSTRACT

Objectives: To improve the cutting sharpness and life while the manufacturing cost is being lowered.

Solution mechanism: The whetstone particle layer (13), which consists of multiple whetstone particle layer units (12), . . . , is configured on the surface (11*a*) of the whetstone substrate (11) while the respective whetstone particle layer units (12) are being mutually linked via the bridge unit (9). The non-whetstone particle unit (22) is configured between whetstone particle layer units (12) and (12). Whetstone particle layer unit (12) is obtained by configuring the superwhetstone particles (14) densely in the central unit (12*a*) and by configuring them sparsely in the peripheral unit (12*b*). The metal coupling phase (17), to which the superwhetstone particles (14) are fixed, is formed by the first and second metal plate phases (15) and (16), respectively. The thickness of the first metal plate phase (15) decreases from the central unit (12*a*) toward the peripheral unit (12*b*) in the shape of a mountain.

6 Claims, 8 Drawing Sheets

ELECTROPLATED GRINDING WHEEL AND ITS PRODUCTION EQUIPMENT AND METHOD

TECHNICAL FIELD OF THE INVENTION

This invention relates to an electroplated grinding wheel, its production method and equipment.

DESCRIPTION OF THE BACKGROUND

Conventionally, when a requested formed abrasive grain layer is formed by electroplating on a grinding wheel substrate (base metal) with use of a masking component, an electroplating method is mainly used as the production method of the electroplated grinding wheel. For example, the said method is done as follows.

First, as shown in FIG. 13, the surface 1*a* of the grinding-wheel substrate (base metal) 1, is masked by the masking component 2, excepting the area which should form the desired abrasive grain layer, and said grinding-wheel substrate 1 is dipped in the electroplating liquid with arranging the surface 1*a* upward.

Next, the super abrasive grains 3 are sprinkled on the non masking area 1*b* of the surface 1*a*. In addition, the super abrasive grains 3 are fixed by depositing the metal plating layer 4 by passing current between the surface 1*a* and the anodes arranged at opposite to the surface 1*a*, while the grinding stone substrate 1 is connected to a power cathode. Moreover, the masking component 2 is removed, and as shown in FIG. 14, the electroplated grinding wheel 6, in which a mono layer 5 of abrasive grains is formed on the grinding stone substrate 1, is obtained.

OBJECT OF THIS INVENTION

However, the following phenomena happen in the electroplated grinding wheel 6 made by the production method mentioned above. The edge part 5*a*, which is a boundary between the masking component 2 and the abrasive grain layer 5, rises up rather than a central area to become thick in the metal plating phase 4. As a result, burrs are occurred on the edge part 5*a*, or the super abrasive grains 3 are projected out rather than said central area by being fixed at the edge part. Therefore, there is a fault that scratches are occurred on a work material, or the grinding precision is fallen at the grinding time. Moreover, there also is a fault that the life of said grinding stone is shortened, since the edge part 5*a* is easily broken at the grinding time.

In addition, the masking component 2 is like a sheet or a film, and must be made by using the photoengraving process, etc., according to the configuration of the abrasive grain layer 5 which should be formed. Moreover, there is a problem that the production cost becomes high, since it is necessary that the masking component 2 is precisely positioned at the time of setting of said masking component.

The object of this invention is to offer the electroplated grinding wheel, which has sharp grinding performance and a prolonged tool life, in view of the above mentioned conditions.

Moreover, the other purpose of this invention is also to offer the production method and its equipment, which are enable to produce easily the electroplated grinding wheel having sharp grinding performance and the prolonged tool life, in low cost.

SUMMARY OF THE INVENTION

In the electroplated grinding wheel having the abrasive grain layer part, in which the multiple abrasive grains are stuck in the metal bonding phase, the electroplated grinding wheel of this invention is characterized that the abrasive grain layer part has the high concentration of the abrasive grain at the center part, and said concentration is relatively low at the surrounding part.

The life of the abrasive grains can be prolonged by arranging the abrasive grains densely in the abrasive grain layer part at the center part. Moreover, sharpness of the abrasive grains can be kept good to prevent the blinding with ground dust by arranging the abrasive grains coarsely at the surrounding part.

In addition, the electroplated grinding wheel of this invention is characterized that the thickness of the metal bonding phase, is thick at the center part, and is gradually decreased towards the surrounding part, in the electroplated grinding wheel which has the abrasive grain layer parts, in which the multiple abrasive grains are fixed in the metal bonding phase.

Since the thickness of the abrasive grain layer part is gradually decreased towards the surrounding part from the center part, the burr, etc., is not occurred at the edge part of said abrasive grain layer part at the grinding time, so that the work material is not damaged and good grinding performance can be done.

Moreover, it may be acceptable that the abrasive grain layer parts are made plural numbers by being separated each other.

Since the non abrasive grain parts, where the abrasive grain layer part is not made, are connected with the separation part among the each abrasive grain layer parts, the ground dust can be exhausted smoothly through these non abrasive grain parts mentioned above, which are used as the exhaust passages. Therefore, the blinding is prevented much more and the sharpness can be improved.

Moreover, it may be acceptable that the plural abrasive grain layer parts are made by being separated each other, above mentioned abrasive grain layer parts are connected with each other, and the abrasive grains are distributed and fixed at the connecting part.

By this way, the blinding at the connecting part is prevented and the sharpness in each abrasive grain layer part can be kept good.

Moreover, the production equipment of the electroplated grinding wheel of this invention is characterized by the following processes. That is, the processes which make to mask the masking component on the grinding stone substrate, excepting for the area which should form abrasive grain layer part, to dip said substrate into the electroplating liquid, to connect said substrate with the cathode, to make the anode at the opposite to said substrate, and to fix the abrasive grains at the non masking area on said substrate with the metal plating. Furthermore, the equipment is also characterized that the masking component comprising the multiple masking parts, and said masking parts are formed like inclined planes, in which the said masking parts are stretched into the space on the non masking area, as departing from its contacting part on the grinding stone substrate.

At the time of fixing of the abrasive grains by metal plating, the concentration of the abrasive grains is high at the center part of the non-masking area, but the abrasive grains are distributed in low concentration at the surrounding part of non masking area, since the abrasive grains cannot enter into the near area of the boundary between the grinding stone substrate and the masking part by existing of the inclined plane of the masking part. Moreover the current density of the plating becomes comparatively dense at the center part, but becomes coarse at the surrounding part, according to approach to the grinding stone substrate, since the current is surrounded by the inclined plane of the multiple masking parts. Therefore, the metal bonding phase is deposited to form that its thickness is decreased towards the surrounding part from the center part. As a result, the burr etc. is not formed at the edge part of the metal bonding phase, or the abrasive grain is not fixed in the projection state.

The production method of the electroplated grinding wheel by this invention is the way, which masks said grinding wheel excepting the area where should form the abrasive grain layer part on the grinding stone substrate, and forms the masking parts, which is in the masking component, like the inclined plane, which is stretched out on the non masking area as departing from the grinding stone substrate. Then, said grinding wheel substrate is dipped in the electroplating liquid, and is passed the current by connecting with the cathode to fix the abrasive grains on the non masking area of the grinding stone substrate with the metal plating.

BRIEF DESCRIPTION OF THE DRAWINGS

FIG. 1(*a*) is an isometric view of an electroplated grinding wheel according to a 1st Example of the invention.

FIG. 1(*b*) is the partial drawing of a vertical section of the electroplated grinding wheel shown in FIG. 1(*a*).

FIG. 7(*b*) shows the thickness distribution of the deposition metal by the metal plating corresponding to the current distribution shown in FIG. 7(a).

BRIEF DESCRIPTION OF THE PREFERRED EMBODIMENTS

Figure 1A:
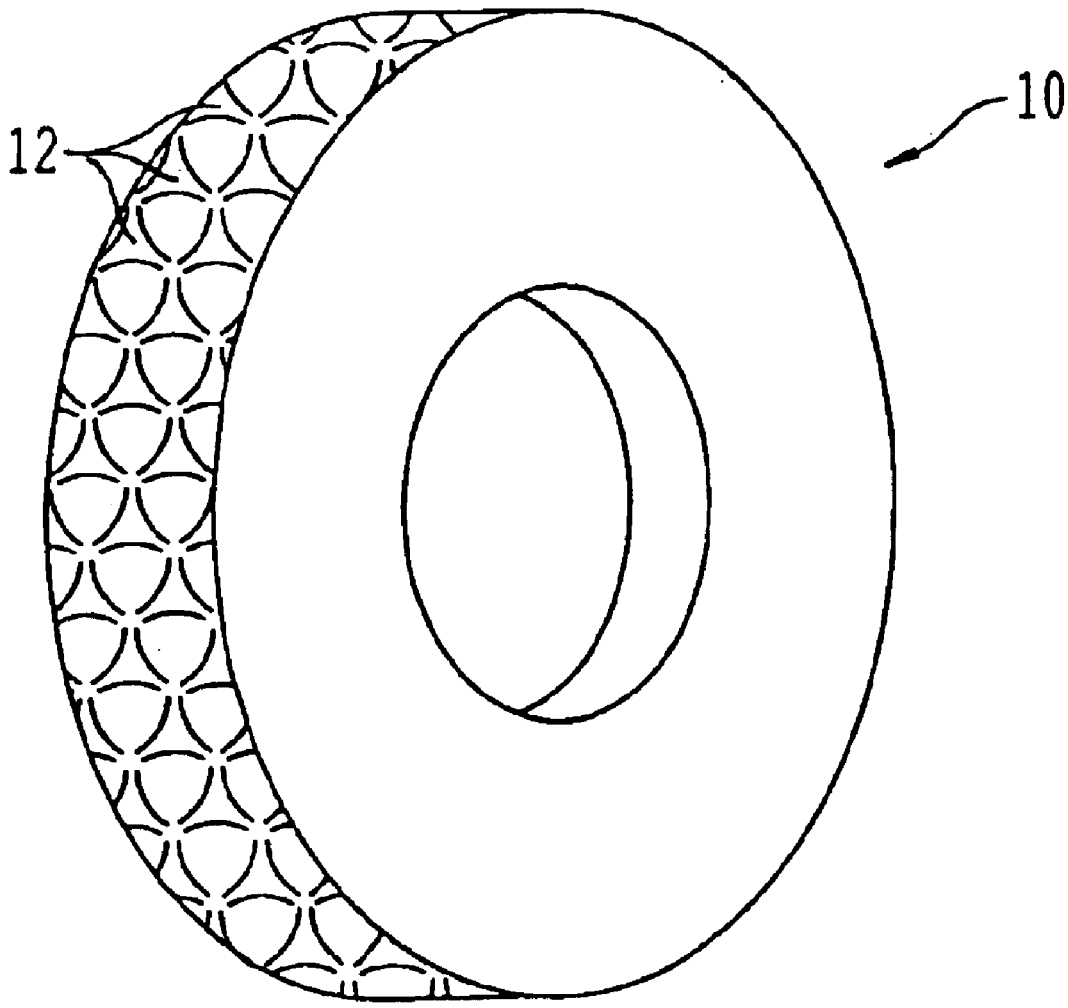
FIG. 1 is the partial drawing of vertical section of the electroplated grinding wheel by the 1st Example of this invention.
Figure 1B:
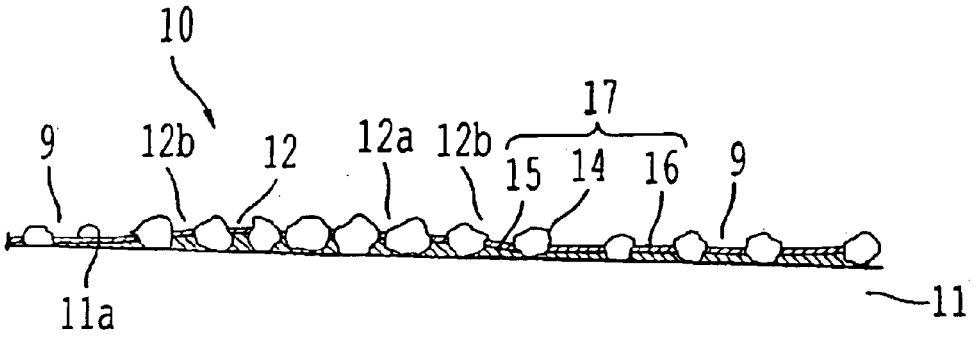
Figure 2:
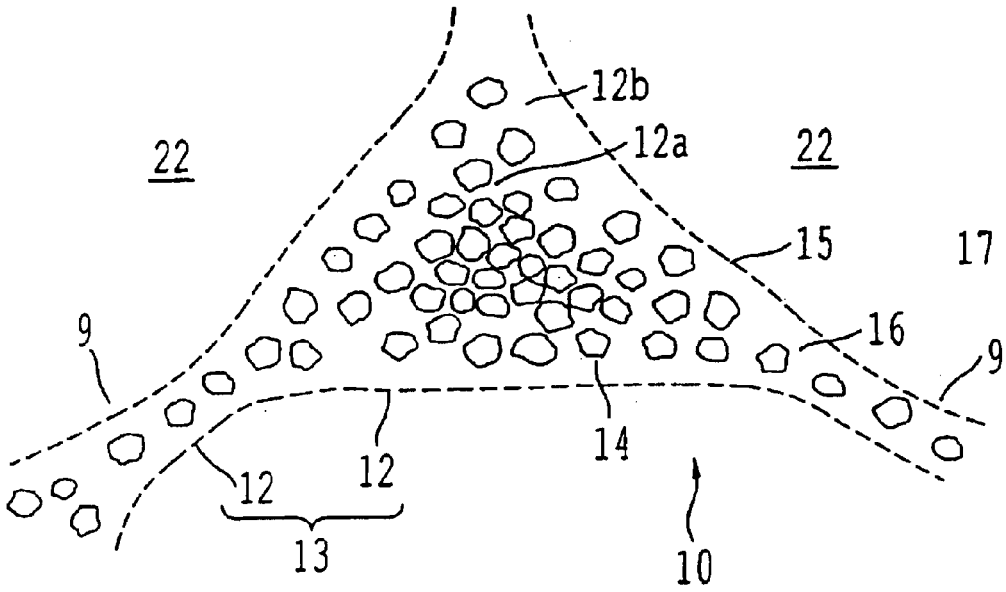
FIG. 2 is the partial floor plane of the abrasive grain layer part of the electroplated grinding wheel shown in FIGS. 1(*a*) and 1(*b*).
Figure 3:
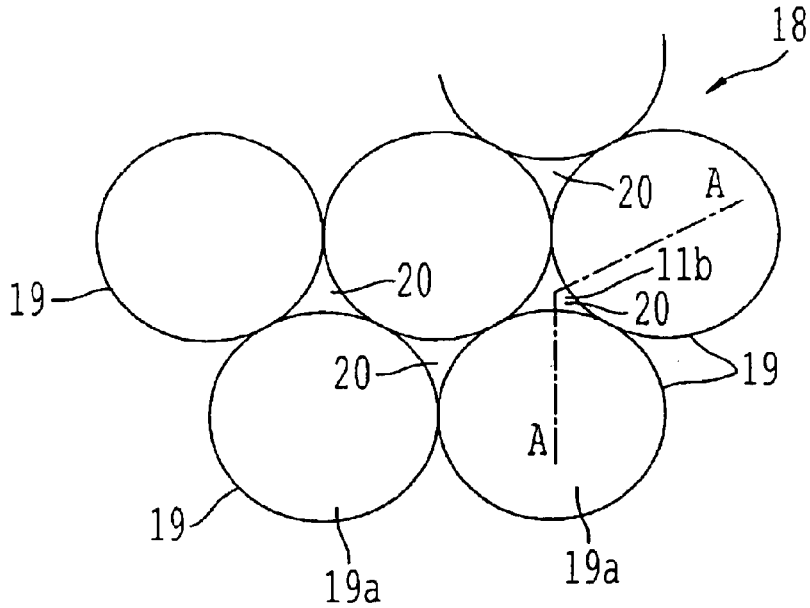
FIG. 3 is the partial floor plane showing the state that the masking components were laid on the surface of the grinding stone substrate.
Figure 4:
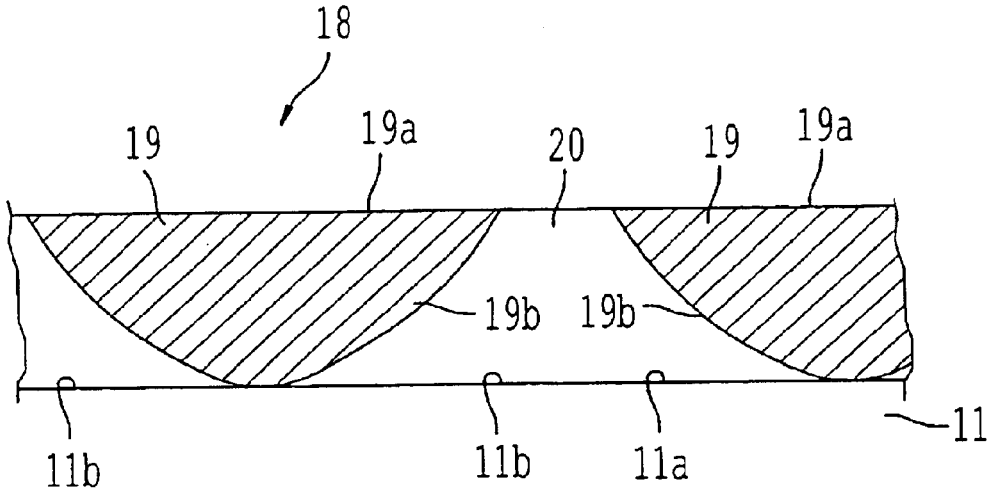
FIG. 4 is the A—A line vertical section of the masking component and the grinding-stone substrate shown in FIG. 3.
Figure 5:
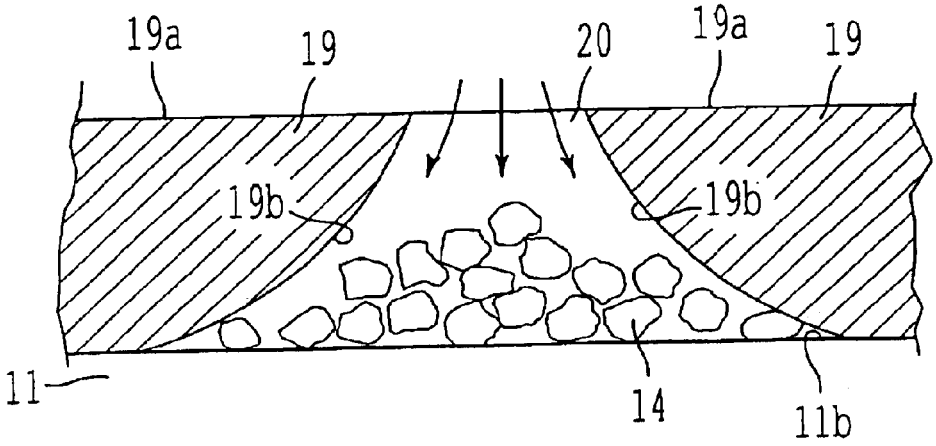
FIG. 5 is the drawing of vertical section showing the state that the super abrasive grains were sprinkled on the non masking area shown in FIG. 4.
Figure 6:
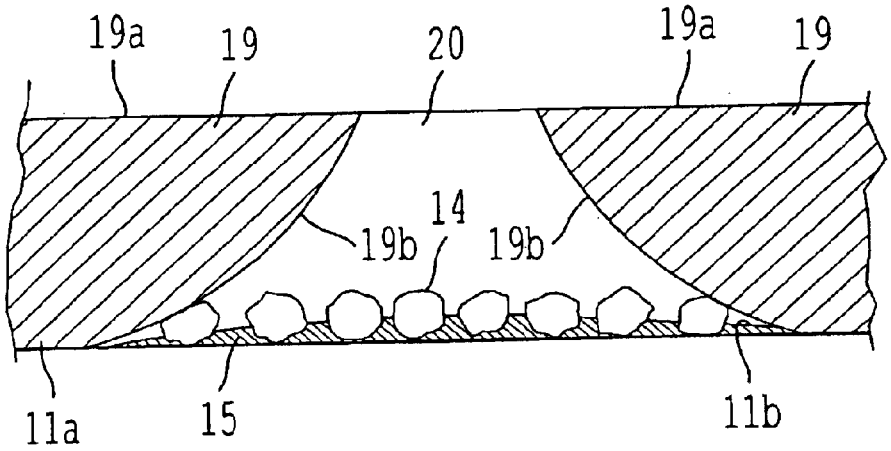
FIG. 6 is the drawing of vertical section showing the state that the super abrasive grains laid on the non masking area were fixed with the metal plating.
Figure 7A:
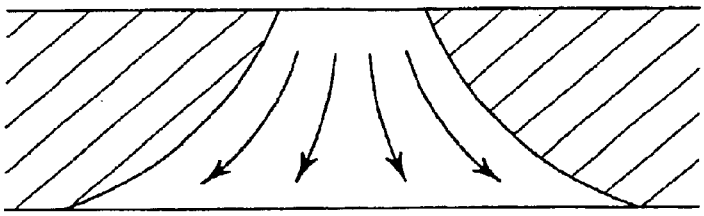
FIG. 7(*a*) shows the current distribution of the non masking area where was faced by the masking component.
Figure 7B:
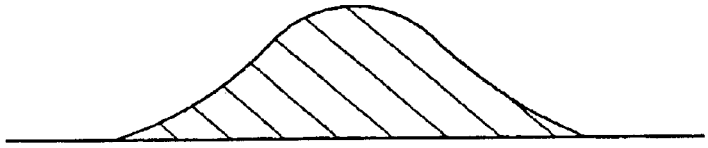

Hereafter, the example of this invention is explained with the appending drawings. FIGS. 1 to 7 is related with the 1st Example. FIG. 1(*a*) is an isometric view of an electroplated grinding wheel. FIG. 1(*b*) is the partial longitudinal sectional plane of the electroplated grinding wheel, and FIG. 2 is the floor plane of the electroplated grinding wheel in FIGS. 1(*a*) and 1(*b*), and FIGS. 3 to 7 are the production method of the electroplated grinding wheel. FIG. 3 is the partial floor plane in the state that the masking component was set on the grinding stone substrate. FIG. 4 is the A—A line sectional plane of FIG. 3. FIG. 5 is the drawing showing the state that the super abrasive grains were dropped on the non masking area. FIG. 6 is the vertical section showing the state that the super abrasive grains were fixed with the metal plating. FIG. 7(*a*) is the figure showing the current distribution of the non masking area. FIG. 7(*b*) is the drawing showing the thickness distribution of the deposited metal with the metal plating, according to the current distribution.

In the electroplated grinding wheel 10 in the example of FIGS. 1 and 2, the plural grinding stone layer parts 12 existed like dots being separated each other on the surface 11*a* of the grinding stone substrate (base metal) 11, which comprises, for example, stainless steel etc., or said plural abrasive grain layer parts 12 are formed like a net by connecting with each other through the bridge part. The electroplated grinding wheel 10 in this example, has the abrasive grain layer 13, in which the plural abrasive grain layer parts 12 are connected with each other like the net through the bridge part 9.

In each abrasive grain layer part 12 included in the abrasive grain layer 13 of the electroplated grinding wheel 10 shown in FIGS. 1 and 2, the multiple super abrasive grains 14 which comprise diamonds or CBN, etc., (it is considered as diamonds in this figure), are arranged on the grinding stone substrate 11, and are fixed in the first metal plating phase 15, which comprises, for example, nickel. This first metal plating phase 15 is formed in the area of the abrasive grain layer parts 12. In addition, on the first metal plating phase 15, the second-metal metal plating phase 16 which comprises, for example, nickel, is formed overall the abrasive grain layer 13. Therefore, the super abrasive grains 14 are fixed by the metal bonding phase 17 which comprises the binary layers of the first metal plating phase 15 and the second metal plating phase 16, and the upside of the super abrasive grains 14 are projected out the outside from the second metal plating phase 16.

Moreover, in each abrasive grain layer part 12, the arrangement density of the multiple super abrasive grains 14 is high at the center part 12*a*, and the arrangement density of the multiple super abrasive grains 14 is low at the surrounding part 12*b* which is the outside of the diameter direction. The number of the super abrasive grains 14 in one abrasive grain layer part 12 is arbitrary, that is, for example, 100 pieces. In this example, although the super abrasive grains 14 are set as a single layer at the abrasive grain part 12, it may be acceptable for said grains 14 that is consisted of two or more layers.

Moreover, the first metal plating phase 15 is formed like a mountain in the vertical section, where the thickness of center part 12*a* is large, and the thickness of the surrounding part 12*b* becomes gradually small, as shown in FIG. 1(*b*).

In addition, as shown in FIG. 2, for example, if the abrasive grain layer part 12 is considered to be formed like an almost triangle, two adjacent abrasive grain layer parts 12 and 12 are connected each other, through the bridge part 9, in which the surrounding parts 12*b* and 12*b* are extended from the top of the almost triangle. In the bridge part 9, the super abrasive grains 14 are set in more coarse interval than the surrounding part 12*b*, and are fixed by the metal bounding phase 17 which comprises the first metal plating phase 15 and the second metal plating phase 16. Therefore, the abrasive grain layer 13 is presenting like the net form, with which the multiple abrasive grain layers 12 are connected at the bridge part 9 through each top part.

The electroplated grinding wheel 10 in this example has the above mentioned structure, and next, the production method of this electroplated grinding wheel 10 is explained with FIG. 3 to FIG. 7.

First, the masking component 18 is set on the surface 11*a* of the grinding stone substrate 11, where the abrasive grain layer should be formed. As shown in FIG. 3 and FIG. 4., this masking component 18 comprises the multiple masking parts 19, which have a half sphere form, made with the non conductivity components, such as plastics, and have a large specific gravity preferably in order to make to dip into the metal plating liquid. The masking component 18 are closed packed in order to contact each other at the almost circular flat surface 19*a* of the each mask part 19 arranged in the flat surface, and are set in the state that the top of the half ball 19*a* was contacted with the surface 11*a* of the grinding-stone substrate 11. In addition, it may be also acceptable that each masking components 18 are connected each other to arrange closely at each contact of the almost circular flat face 19*a* of each mask part 19 arranged flatly.

Moreover, the grinding stone substrate 11 is dipped into the electrolytic metal plating liquid with the masking component 18, and the surface 11*a* is arranged upward horizontally.

By this state, the almost triangle clearance 20 is formed among three masking parts 19, 19, and 19, in the plane view shown in FIG. 3, and the super abrasive grains 14 are dropped from these clearances 20 to the non-masking area 11*b* of surface 11*a* of the grinding stone substrate 11, as shown in FIG. 5. In the case of the feed of the super abrasive grains 14, if the grinding stone substrate 11 is vibrated with the masking component 18, the super abrasive grains 14 can be fallen efficiently.

The non-masking area 11*b* of the grinding stone substrate 11 corresponding to the clearance 20, becomes broader to an overall than the clearance 20, for the half sphere face 19*a* of the masking part 19, and is in the state that the non masking areas 11*b* and 11*b*, corresponding to the adjacent clearances 20 and 20 which are separated each other, are passed seriously each other. Since the super abrasive grains 14 are laid on the non masking area 11*b* excepting the area of the half sphere face 19*a* of the masking part 19, the arrangement density of the super abrasive grains 14 is high at the center part which counters the clearance 20 of the non masking area 11*b*. On the other hand, on the surrounding part, since the inclined plane on the convex surface of half sphere face 19*a* is stretched on the non masking area 11*b*, the super abrasive grains are regulated to be few, and so that the arrangement density becomes coarse.

Next, while the grinding stone substrate 11 is connected to the power cathode, the current is passed between the surface 11*a* and the anode arranged at the opposite of the surface 11*a* (not shown), and the first metal plating phase 15, which comprises nickel, etc., is deposited to fix the super abrasive grains 14. At this time, the thickness of the first metal plating phase 15 is controlled by each half sphere face 19*b* of the multiple masking parts 19 which form the clearance 20.

Thus, as shown in FIG. 7(*a*), the current, which flows from the anode to the cathode (grinding stone substrate 11) between the anode and cathodes in electric metal plating liquid, is diffused to spread out like an unfolded fan, along with the half sphere part 19*b* of the masking part 19 towards the non masking area 11*b* from the inlet of the clearance 20. Therefore, the current density becomes high at the center part of the non masking area 11*b*, and low at the surrounding part, so that first-metal plating phase 15 is formed like an almost mountain, where the thickness of the metal plating is thick at center part 12*a* and is decreased gradually at the surrounding part 12*b* along with the current density. The thickness of the metal plating is restricted by the half sphere face 19*b* of the masking part 19, at the surrounding part 12*b* of the first metal plating phase 15.

Moreover, the super abrasive grains 14 sprinkled from the clearance 20, are arranged with coarse density between the adjacent non masking areas 11*b* and 11*b*, and are fixed with the thin first metal plating phase 15, at the time of the metal plating, to form the bridge part 9 connecting the abrasive grain layer part 12 with the abrasive grain layer part 12.

Next, the excessive super abrasive grains 14, which are not fixed, are removed, while the masking component 18 is removed, and the current is passed again between the anode and the cathode (grinding stone substrate 11), to form the metal bonding phase 17 by depositing the second metal plating phase 16 overall.

In the electroplated grinding wheel 10 obtained by this way, as shown in FIG. 1 and FIG. 2, the near area, where the top of the half sphere face 19*b* of the masking part 19 is contacted with the surface 11*a* of the grinding stone substrate 11, becomes to the non abrasive grain part 22 in which the abrasive grain layer part 12 is not formed. As the result, the abrasive grain layer part 13 is obtained, where the abrasive grain layers 12 are formed respectively to connect with the bridge parts 9 at the non masking area 11*b* corresponding to the clearances 20 formed in three masking parts 19, 19, and 19. Therefore, at the abrasive grain layer 13, the non abrasive grain part 22 and the abrasive-grain layer part 12 are arranged alternately.

When the grinding is done by using the produced electroplated grinding wheel 10 made by this way, the grinding of the work material is done with each abrasive grain layer part 12. At this time, at the surrounding part 12*b* of the abrasive grain layer part 12, since the abrasive grain density is small to be difficult to be blinded, the sharpness is kept good. In addition, at the center part 12*a*, the abrasive grain density is high and so, its durability becomes high.

Moreover, the ground dust can be stored, at the non abrasive grain part 22 between the abrasive grain layer parts 12 and 12.

According to this example as mentioned above, each abrasive grain layer part 12 of the electroplated grinding wheel 10, has the high abrasive grain density to have good durability at the center part 12*a*, and has the small abrasive grain density to be difficult to be blinded at the surrounding part 12*b*. So its sharpness is good. Moreover, the first metal plating phase 15 and the second metal plating phase 16, are formed like the mountain in which the thickness of the metal plating becomes thin gradually from the center part 12*a* to the surrounding part 12*b* of abrasive grain layer part 12. Therefore, as compared with the electroplated grinding wheel produced by the conventional masking, the burr is not made to the edge part, or the super abrasive grains 14 are not fixed to be upheaved, so that there is not scratches, etc., on the work material at the grinding.

Moreover, as the masking component 18, since the almost half sphere masking parts 19 are closed packed to arrange in X-Y direction in FIG. 11*a* on the surface 11*a* of the grinding stone substrate 1, it does not necessary to make by the photoengraving process like the conventional masking component and the complicated positioning. Therefore, it can be produced in the low cost and easily. In addition, it is easy to adjust the size of the abrasive grain layer part 12, the arrangement distance, and the concentration of the super abrasive grains 14, by increasing or decreasing the radius of the masking parts 19. When the radius of the masking parts 19 becomes large, the clearance 20 increases and the concentration also increases. When the radius of the masking parts 19 becomes small, the clearance 20 reduces, and the concentration also becomes small.

Next, the other example of this invention is explained by using the same code, which is used for the same segment and component as the above mentioned example.

Figure 8:
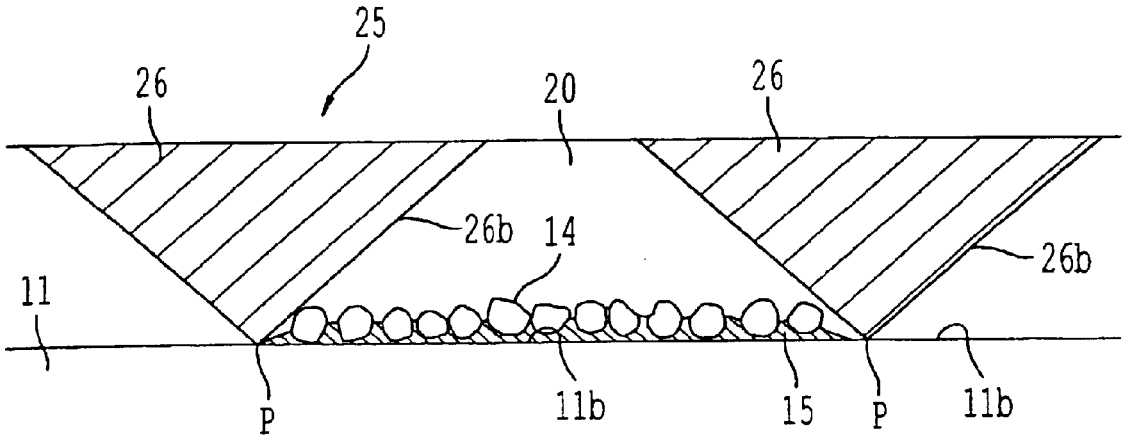
FIG. 8 is the drawing of vertical section showing the state that the masking part and super abrasive grains fixed with the metal plating in the 2nd Example as same as FIG. 4.

FIG. 8 shows the masking component used for the production of the electroplated grinding wheel by the second example, and is the vertical section same as FIG. 4.

The masking component 25 used in the production method of the electroplated grinding wheel in the 2nd Example, has the multiple mask parts 26, which like cone configuration respectively, and are closed packed and arranged while their apexes P of said cones contact with the surface 11*a* of the grinding stone substrate 11. In the case of this mask parts 26, the configuration of the clearance 20 is the same as the 1st Example, but the area of the non masking area 11*b* on the surface 11*a* of the grinding-stone substrate 11, increases substantially. Moreover, when the super abrasive grains 14 are sprinkled through the clearance 20, the abrasive grain density of the surrounding part 12*b* at the non masking area 11*b*, becomes high, as compared with the abrasive grain layer part 12 of the first example, because of the cone circumference side 26*b* of the mask part 26.

Figure 9:
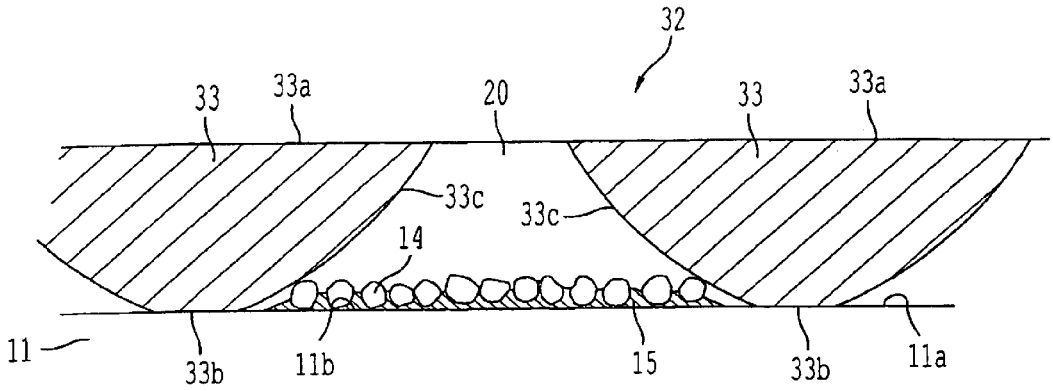
FIG. 9 is the drawing of vertical section showing the state that the masking part and super abrasive grains in the 3rd Example fixed with the metal plating as same as FIG. 4.
Figure 10:
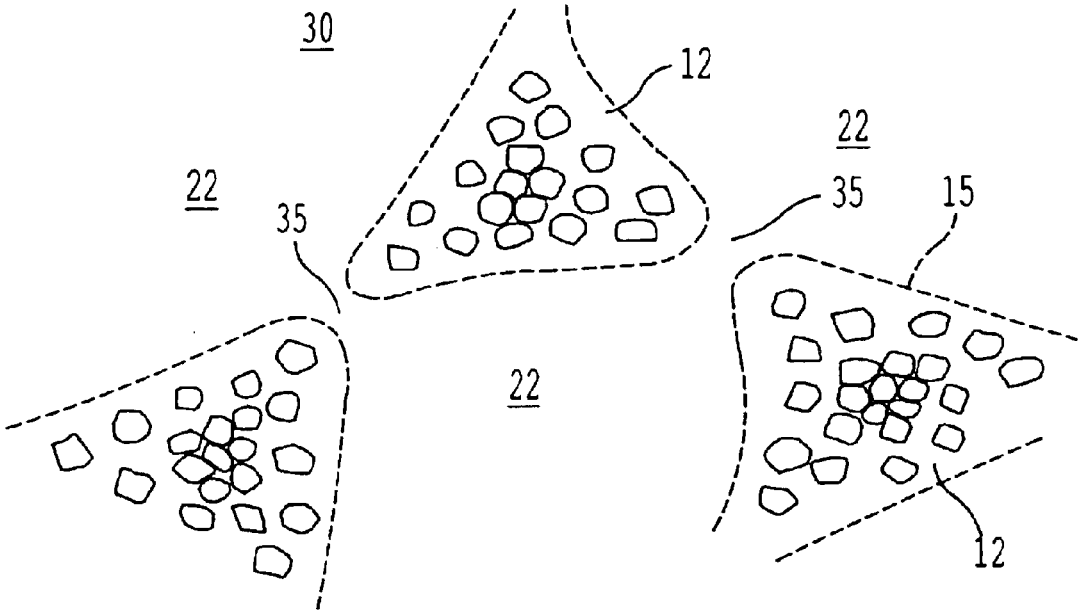
FIG. 10 is the floor plane of the abrasive grain layer part obtained using the masking component shown in FIG. 9.

Next, the third example of this invention is explained with FIG. 9 and FIG. 10. FIG. 9 is the drawing of vertical section which showing the masking component used for the production of the electroplated grinding wheel by the 3rd Example, and FIG. 10 is the partial floor plane of the electroplated grinding wheel 30, which is produced by using the masking component shown in FIG. 9.

The masking component 32 used in the production method in the 3rd Example, comprises the multiple masking parts 33 being closed packed and arranged in the X-Y direction. Each masking part 33 is the almost truncated-cone form, and the upper face 33*a* and the under face 33*b*, which are like a circle, are countered each other. The under face 33*b* has the smaller diameter than that of the upper face 33*a*, and is contacted to the surface 11*a* of the grinding stone substrate 11. Moreover, the side face 33*c* is the convex face and becomes the inclined face as reducing the diameter gradually from upper face 33*a* to under face 33*b*.

By constituting the masking component 32 in this way, when the super abrasive grains 14 are sprinkled through the clearance 20 to the non-masking range 11*b* of the grinding stone substrate 11, each abrasive grain layer 12 is formed in the separated state each other like islands without bridge parts 9 where the super abrasive grain 14 are arranged linearly to connect the abrasive grain layer part 12 with the adjacent abrasive grain part 12, since the under face 33*b* of the masking part 33 is broad and is contacted with the face.

Therefore, in each abrasive-grain layer part 12, as shown in FIG. 10, the first metal plating phase 15 which fixes the super abrasive grains 14, has the constitution in which said first metal plating phases 15 are separated each other through the separation part 35. Therefore, the non abrasive grain part 22 prepared between the abrasive grain layer parts 12 and 12, are passed each other through the separation part 35, so that the ground dust can be exhausted smoothly.

Figure 11:
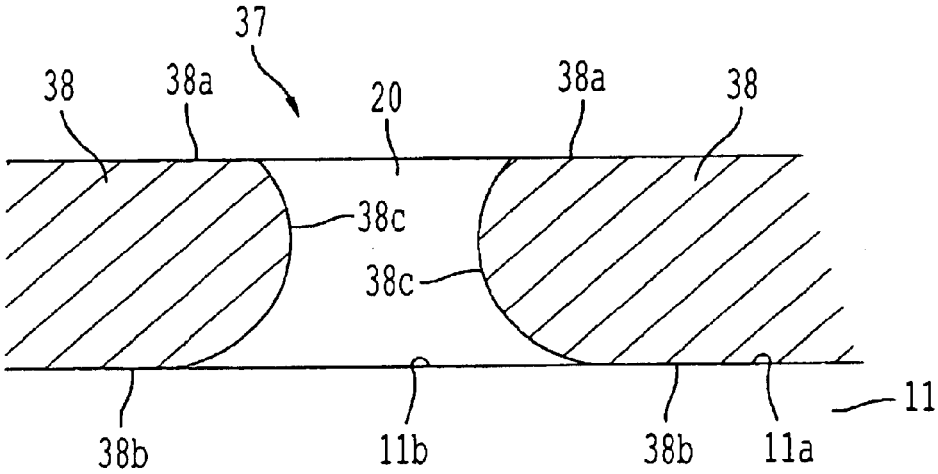
FIG. 11 is the drawing of the vertical section showing the modification of the masking part the 3rd Example as same as FIG. 4.

Next, FIG. 11 shows the other masking component, and this masking component 37 is the modification example of the masking component 32 shown in FIG. 9. In the multiple masking parts 38 comprising said masking component 37, the side face 38 connects upper face 38*a* with the under face 38*b*, which are almost circular form, and decreases its radius gradually, after expanding the radius gradually towards under face 38*b* from top face 38*a*. As the result, said side face 38 has the almost circular convex face in the cross section.

When the mask part 38 is comprised in this way, the clearance 20 among the mask parts 38 each other is expanded at the upper side, and the introduction of the super abrasive grains 14 to the non masking range 11*b* by sprinkling, becomes easy.

Figure 12:
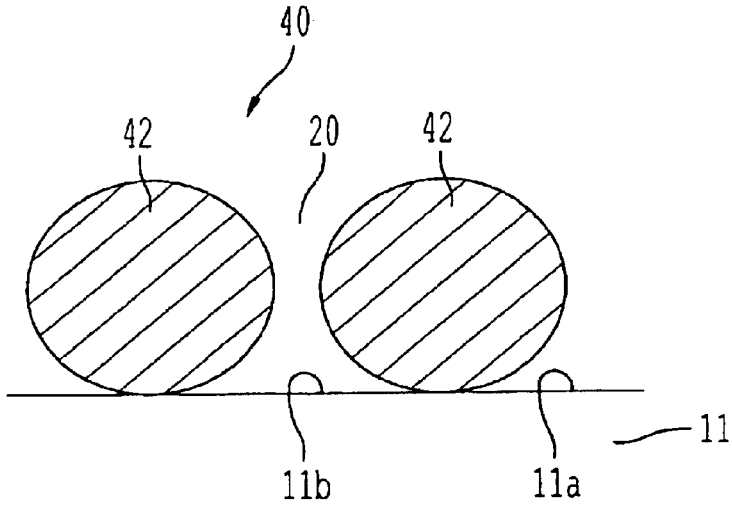
FIG. 12 is the drawing of the vertical section showing the masking part in the 3rd Example.
Figure 13:
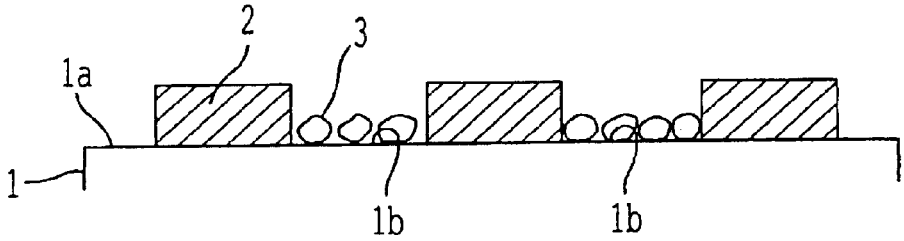
FIG. 13 RELATED ART
FIG. 13 is the drawing of the vertical section of the principal part showing the state that the super abrasive grains were laid on the grinding stone substrate having the masking part by the conventional production method of the electroplated grinding wheel.
Figure 14:
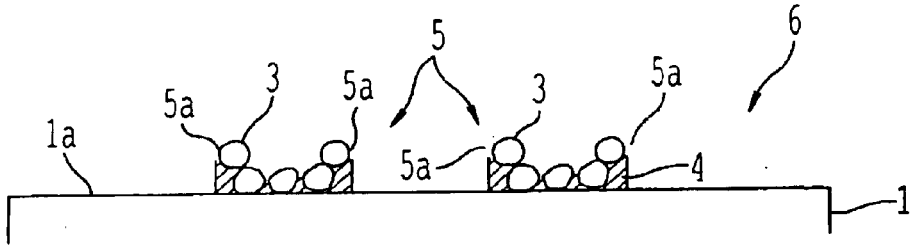
FIG. 14 RELATED ART
FIG. 14 is the partial drawing of vertical section of the electroplated grinding wheel produced by using the masking part in FIG. 13.

In addition, the configuration of the mask part can be take arbitrary without being limited to the each above mentioned example. For example, as the masking component 40 shown in FIG. 12, it may be acceptable that each multiple mask parts 42 are formed like a sphere which has a suitable radius, and these spheres are closed packed and arranged to contact each other. In this case, when the frame mold of the suitable configuration, such as a ring, is made at the periphery of the abrasive grain layer 13, to close pack said masking parts 42 inside of said ring, the positioning can be done easily.

Moreover, in the each above mentioned example, the electrolytic metal plating was done to fix the super abrasive grains 14, after the super abrasive grains 14 were sprinkled on the grinding stone substrate 11, but this invention is not limited to such production methods. For example, it may be also acceptable that the current can be passed, while metal plating liquid is stirring, where the super abrasive grains 14 are mixed into the electrolytic metal plating liquid, and said super abrasive grains 14 can be deposited to be fixed with the metal on the grinding-stone substrate 11 which is the cathode.

Moreover, blocky super abrasive grains are sufficient as the super abrasive grains 14, or general abrasive grains can also be used instead of the super abrasive grains.

In the each above mentioned example, the super abrasive grains 14 are fixed in the metal bonding phase 17 which comprises the first metal plating phase 15 and second metal plating phase 16. However, it may be acceptable that the super abrasive grains 14 can also be fixed with only the first metal plating phase 15 as the metal bonding phase 17, without being limited to said method.

In addition, it is also acceptable that the quality of the material of each masking part, which comprises the masking components 18, 25, 32, 37, and 40, is other suitable non-conductivity components, for example, glasses or rubbers, etc., without being limited to plastics.

As explained above, about the electroplated grinding wheel of this invention, the abrasive grain layer part has the high concentration of the abrasive grains at the center part, and has the comparatively low concentration at the surrounding part. Therefore, the life of the abrasive grain layer part can be prolonged at the center part, and the blinding of the ground dust can be prevented at the surrounding part, so that the sharpness of the abrasive grains can be kept good.

Moreover, about the electroplated grinding wheel of this invention, the thickness of the metal bonding phase is thick at the center part, and is decreased gradually towards the surrounding part, so that the thickness of the abrasive grain layer part is decreased gradually towards the surrounding part from the center part. Therefore, since the burr, etc., is not occurred in the edge part at the grinding time, the good grinding performance can be obtained without damaging the work material.

Moreover, since the abrasive grain layer parts are separated each other and made plural numbers, the exhaust passages of ground dust can be made among the abrasive grain layer parts to exhaust the ground dust smoothly with preventing the blinding much more. In this way, the sharpness can be improved.

In addition, the abrasive grain layer parts are separated each other, made plural numbers, and are connected each other through the bridge parts. These abrasive grains are distributed and fixed at this bridge part, so that the sharpness of each abrasive grain layer part is good, and the blinding at the bridge part can be prevented.

In addition, about the production equipment of the electroplated grinding wheel of this invention, the masking component comprises the multiple masking parts, and said masking parts are formed like the inclined plane, which is stretched in the space on the non masking area as departing from the segment of contact with the grinding stone substrate. Therefore, at the time of the fixing of the abrasive grains by the metal plating, the concentration of the abrasive grain is high at the center part of the non-masking range, and the abrasive grains are distributed at the surrounding part with the low concentration, since said abrasive grains cannot enter into the boundary area between the grinding stone substrate and the masking part by the mask part. In addition, the current density of the plating current, which is surrounded with the inclined plane of the multiple mask parts, is comparatively dense at the center part, and becomes coarse at the surrounding part, as approaching to the grinding stone substrate. Therefore, the deposited metal bonding phase is formed with the configuration that its thickness is decreased towards the surrounding part from the center part, the burr, etc., is not formed, and the abrasive grains are not fixed in the projection state, at the edge part of the metal bonding phase.

The production method of the electroplated grinding wheel by this invention comprising, masking on the grinding stone substrate except for the area, which should form the abrasive grain layer part, with the masking component which comprises the masking parts, forming the masking parts like the inclined plane which is stretched on the non masking area as departing from the grinding stone substrate, dipping into the metal plating liquid, connecting the grinding stone substrate to the cathode, and passing the current to fix the abrasive grains on the non masking area on the grinding stone substrate with the metal plating.

Therefore, at the time of the fixing of the abrasive grains with the metal plating, the concentration of the abrasive grains is high at the center part of the non masking area, and the abrasive grains are distributed in the low concentration at the surrounding part. Moreover, according to the variation of the current density of the metal plating, the deposited metal bonding phase is formed with the configuration that its thickness is decreased towards the surrounding part from the center part, the burr etc. is not formed, and the abrasive grains are not fixed in the projection state, at the edge part of the metal bonding phase.

What is claimed:

1. An electroplated grinding wheel having abrasive grain layer parts for grinding in which plural abrasive grains are fixed with a metal bonding phase comprising:

said abrasive grain layer part has a high abrasive grains concentration at a center part of said abrasive grain layer part and a low abrasive grain concentration at an area surrounding the center part of said abrasive grain layer part.

2. An electroplated grinding wheel according to claim 1 comprising:

said abrasive grain layer parts are made in plural numbers by separating each other.

3. An electroplated grinding wheel according to claim 1 comprising:

said abrasive grain layer parts are made in plural numbers by separating each other and are connected to each other through bridge parts and the abrasive grains are separated and fixed at said bridge parts.

4. An electroplated grinding wheel having abrasive grain layer parts in which plural abrasive grains are fixed with a metal bonding phase comprising:

a portion of said metal bonding phase that includes the plural abrasive grains having a thickness which is decreased gradually from a center part of the metal bonding phase toward a surrounding area.

5. An electroplated grinding wheel according to claim 4, comprising:

said abrasive grain layer parts are made in plural numbers by separating each other.

6. An electroplated grinding wheel according to claim 4 comprising:

said abrasive grain layer parts are made in plural numbers by separating each other and are connected to each other through bridge parts and the abrasive grains are separated and fixed at said bridge parts.

* * * * *